US010885855B2

(12) United States Patent
Park

(10) Patent No.: US 10,885,855 B2
(45) Date of Patent: Jan. 5, 2021

(54) DISPLAY DEVICE AND METHOD OF COMPENSATING FOR DEGRADATION THEREOF

(71) Applicant: Samsung Display Co., Ltd., Yongin-si (KR)

(72) Inventor: Jong Woong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/514,909

(22) Filed: Jul. 17, 2019

(65) Prior Publication Data

US 2020/0043419 A1 Feb. 6, 2020

(30) Foreign Application Priority Data

Aug. 2, 2018 (KR) ..... 10-2018-0090337

(51) Int. Cl.

| | |
|---|---|
| ***G09G 3/3275*** | (2016.01) |
| ***G09G 3/3266*** | (2016.01) |
| ***G09G 3/3258*** | (2016.01) |
| ***G09G 3/3233*** | (2016.01) |

(52) U.S. Cl.

CPC ..... *G09G 3/3275* (2013.01); *G09G 3/3233* (2013.01); *G09G 3/3258* (2013.01); *G09G 3/3266* (2013.01)

(58) Field of Classification Search

CPC .. G09G 3/3275; G09G 3/3233; G09G 3/3258; G09G 3/3266

See application file for complete search history.

(56) References Cited

U.S. PATENT DOCUMENTS

| | | | | |
|---|---|---|---|---|
| 7,675,492 | B2 | 3/2010 | Park et al. | |
| 10,062,327 | B2 | 8/2018 | Tani et al. | |
| 10,062,328 | B2 | 8/2018 | Lee et al. | |
| 2017/0032743 | A1* | 2/2017 | Lee | G09G 3/3233 |
| 2017/0287397 | A1* | 10/2017 | Sawa | G09G 3/3233 |

FOREIGN PATENT DOCUMENTS

| | | |
|---|---|---|
| KR | 10-2016-0141323 | 12/2016 |
| KR | 10-2017-0014075 | 2/2017 |

* cited by examiner

*Primary Examiner* — Lisa S Landis

(74) *Attorney, Agent, or Firm* — H.C. Park & Associates, PLC

(57) ABSTRACT

A display device includes: a plurality of pixels each of which includes a light emitting element and a driving transistor having a source region separated from a drain region by a first distance to control an amount of current flowing through the light emitting element; a timing controller to convert a first image data input into a second image data, using a data correction coefficient set corresponding to the first distance of one of the plurality of pixels; and a data driver to generate a data signal corresponding to the second image data and supplying the data signal to the one of the plurality of pixels. A method of compensating for degradation of a display device also is disclosed.

15 Claims, 5 Drawing Sheets

DISPLAY DEVICE AND METHOD OF COMPENSATING FOR DEGRADATION THEREOF

CROSS-REFERENCE TO RELATED APPLICATION

This application claims priority from and the benefit of Korean Patent Application No. 10-2018-0090337, filed on Aug. 2, 2018, which is hereby incorporated by reference for all purposes as if fully set forth herein.

BACKGROUND

Field

Exemplary implementations of the invention relate generally to a display device and, more particularly, to a display device and method of compensating for pixel degradation thereof.

Discussion of the Background

With the development of information technologies, the importance of a display device which is a medium between a user and information increases. Accordingly, display devices such as a liquid crystal display device, an organic light emitting display device, and a plasma display panel (PDP) are increasingly being used.

Among these display devices, the organic light emitting display device displays images using an organic light emitting diode that generates light by recombination of electrons and holes. The organic light emitting display device has a high response speed and is driven with low power consumption.

The organic light emitting display device includes a plurality of pixels located in a region defined by a plurality of data lines and a plurality of scan lines. Each of the pixels generally includes an organic light emitting diode, two or more transistors including a driving transistor, and one or more capacitors.

The organic light emitting diode included in each of the pixels is degraded as time elapses, and accordingly, an image with the desired brightness is not displayed. The above information disclosed in this Background section is only for understanding of the background of the inventive concepts, and, therefore, it may contain information that does not constitute prior art.

SUMMARY

Applicant recognized that improved devices and methods are needed to compensate for the decrease in brightness due to degradation of the light emitting elements, particularly organic light emitting diodes in organic light emitting display devices.

Devices constructed according to, and methods following, exemplary implementations of the invention are capable of displaying an image with uniform brightness by compensating for degradation of a light emitting element on a pixel by pixel basis.

The brightness compensation principles of the invention may account for Applicant's discovery that the speed at which an individual pixel is degraded may vary depending on the distance between the source region and the drain region of its driving transistor.

Additional features of the inventive concepts will be set forth in the description which follows, and in part will be apparent from the description, or may be learned by practice of the inventive concepts.

According to an aspect of the invention, there is provided a display device including: a plurality of pixels each of which includes a light emitting element and a driving transistor having a source region separated from a drain region by a first distance to control an amount of current flowing through the light emitting element; a timing controller to convert a first image data input into a second image data, using a data correction coefficient set corresponding to the first distance of one of the plurality of pixels; and a data driver to generate a data signal corresponding to the second image data and to supply the data signal to the one of the plurality of pixels.

The timing controller may include: a calculator to calculate and store cumulative stress information of at least some of the plurality of pixels, based on the first image data; a memory to store the data correction coefficient; and a data corrector to convert the first image data into the second image data, using the cumulative stress information and the data correction coefficient on a pixel by pixel basis.

The data correction coefficient may be calculated by applying a weighted value corresponding to the distance between the source region and the drain region of the driving transistor to a reference data correction coefficient.

The weighted value may be set to decrease when the distance between the source region and the drain region of the driving transistor increases.

The data correction coefficients respectively corresponding to a plurality of cumulative stress information having different values may be stored in the memory.

The data correction coefficient may be used to compensate for degradation of the light emitting element.

The distance between the source region and the drain region of the driving transistor may be the shortest distance between the source region and the drain region.

According to an aspect of the invention, there is provided a method of compensating for degradation of a display device including a plurality of pixels each of which including a light emitting element and a driving transistor to control an amount of current flowing through the light emitting element, the method including the steps of: storing, in a memory, a plurality of data correction coefficients corresponding to a previously measured distance between a source region and a drain region of the driving transistor of at least some of the plurality of pixels; and converting, by a timing controller, a first image data input into a second image data, using the plurality of data correction coefficients to drive at least some of the plurality of pixels.

The method may further include the step of calculating, by the timing controller, cumulative stress information of at least some of the plurality of pixels, based on the first image data.

The second image data may be converted using one of the plurality of data correction coefficients corresponding to the calculated cumulative stress information.

The plurality of data correction coefficients may be calculated by applying a weighted value corresponding to the distance between the source region and the drain region of the driving transistor to a reference data correction coefficient.

The weighted value may be set to decrease when the distance between the source region and the drain region of the driving transistor increases.

The weighted value may be set to increase when the distance between the source region and the drain region of the driving transistor decreases.

The distance between the source region and the drain region of the driving transistor may be the shortest distance between the source region and the drain region.

The plurality of data correction coefficients may be used to compensate for degradation of the light emitting element.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
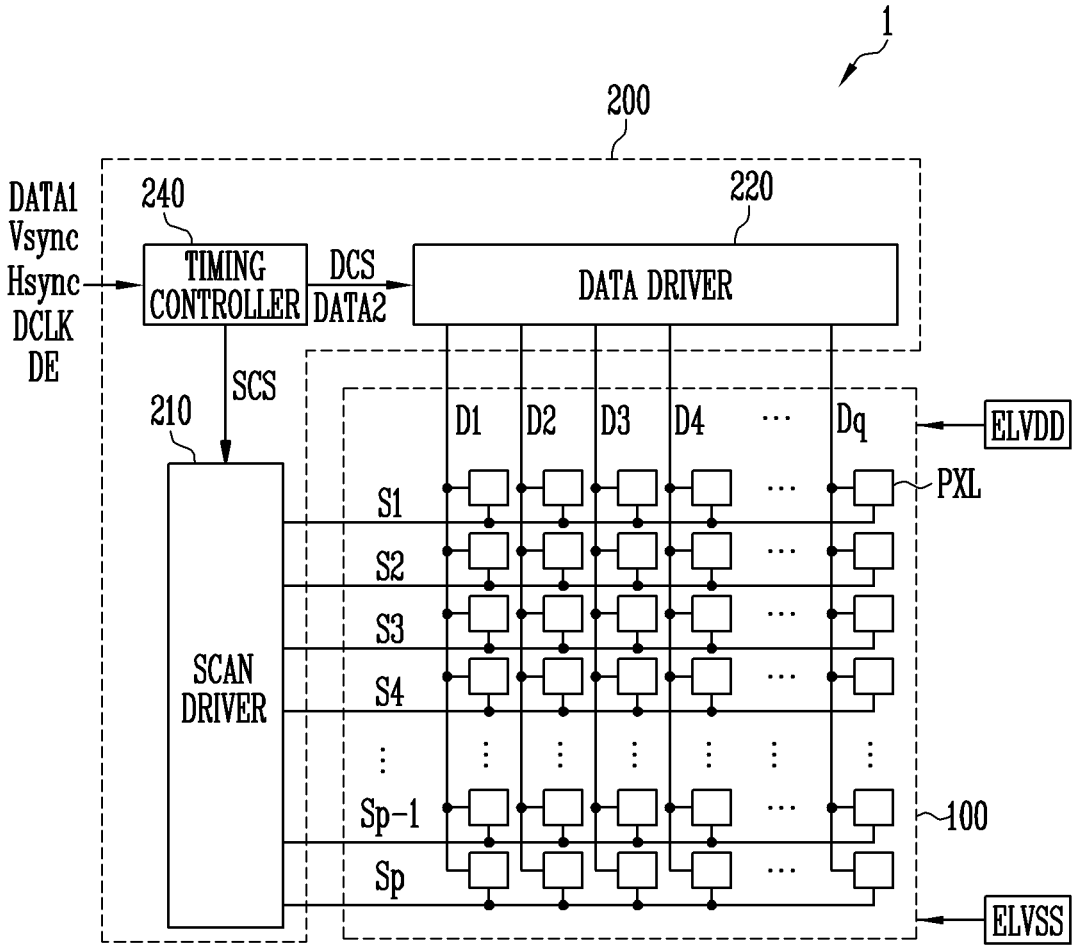
FIG. 1 is a block diagram schematically illustrating a configuration of a display device constructed according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalties between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram schematically illustrating a configuration of a display device constructed according to an exemplary embodiment of the invention.

Referring to FIG. 1, the display device 1 according to the exemplary embodiment of the invention may include a display unit 100 and a display driver 200.

The display unit 100 may include pixels PXL, and data lines D1 to Dq and scan lines S1 to Sp, which are connected to the pixels PXL.

Each of the pixels PXL may be supplied with a data signal and a scan signal through a corresponding one of the data lines D1 to Dq and a corresponding one of the scan lines S1 to Sp.

Also, the pixels PXL may be connected to a first power source ELVDD and a second power source ELVSS. The first power source ELVDD may be a high-potential voltage, and the second power source ELVSS may be a low-potential voltage.

Each of the pixels PXL may include a light emitting element (or a light emitting device, e.g., an organic light emitting diode), and generate light corresponding to the data signal by a current flowing from the first power source ELVDD to the second power source ELVSS via the light emitting element.

The display driver 200 may include a scan driver 210, a data driver 220, and a timing controller 240.

The scan driver 210 may supply scan signals to the scan lines S1 to Sp in response to a scan driver control signal SCS. For example, the scan driver 210 may sequentially supply the scan signals to the scan lines S1 to Sp.

In order to connect the scan driver 210 to the scan lines S1 to Sp, the scan driver 210 may be mounted directly on a substrate on which the pixels PXL are formed, or be connected to the substrate through a separate component such as a flexible printed circuit board.

The data driver 220 may receive a data driver control signal DCS and second image data DATA2 from the timing controller 240, to generate a data signal.

The data driver 220 may supply the generated data signal to the data lines D1 to Dq.

In order to connect the data driver 220 to the data lines D1 to Dq, the data driver 220 may be mounted directly on the substrate on which the pixels PXL are formed, or be connected to the substrate through a separate component such as a flexible printed circuit board.

When a scan signal is supplied to a specific scan line, some pixels PXL connected to the specific scan line may be supplied with a data signal transferred from the data lines D1 to Dq. These pixels PXL then may emit light with a brightness corresponding to the supplied data signal.

The timing controller 240 may generate control signals for controlling the scan driver 210 and the data driver 220.

For example, the control signals may include the scan driver control signal SCS for controlling the scan driver 210 and the data driver control signal DCS for controlling the data driver 220.

The timing controller 240 may generate the scan driver control signal SCS and the data driver control signal DCS, using an external input signal.

For example, an external input signal may include a dot clock DCLK, a data enable signal DE, a vertical synchronization signal Vsync, and a horizontal synchronization signal Hsync.

Also, the timing controller 240 may supply the scan driver control signal SCS to the scan driver 210, and supply the data driver control signal DCS to the data driver 220.

The timing controller 240 may convert first image data DATA1 input from the outside into second image data DATA2 suitable for specifications of the data driver 220, and supply the second image data DATA2 to the data driver 220.

The first image data DATA1 may include brightness information of each of the pixels PXL of the display unit 100, and brightness may have a set number, e.g., 1024, 256 or 64 grays. However, the invention is not limited thereto, and the brightness may have another value. In addition, the input first image data DATA1 may be divided in units of frames.

The timing controller 240 may generate and output the second image data DATA2 by performing image processing such as brightness compensation on the first image data DATA1.

The data enable signal DE may be a signal for defining a period in which valid data is input, and one period may be set as one horizontal period such as one period of the horizontal synchronization signal Hsync.

Although FIG. 1 illustrates that the scan driver 210, the data driver 220, and the timing controller 240 are provided separately from each other, at least some of the components may be integrated, if necessary.

Figure 2:
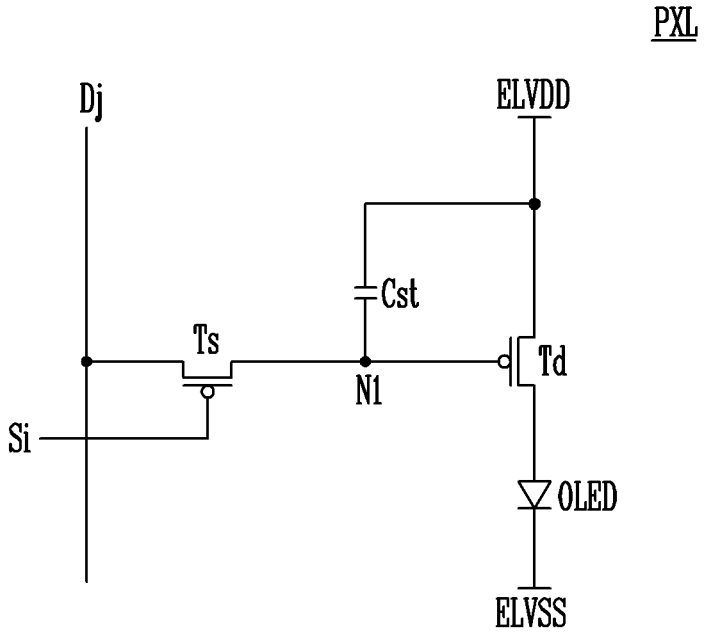
FIG. 2 is a circuit diagram illustrating a structure of a representative pixel shown in FIG. 1.

FIG. 2 is a circuit diagram illustrating a structure of the representative pixel shown in FIG. 1. For convenience of description, a pixel PXL connected to an ith scan line Si and a jth data line Dj is illustrated in FIG. 2.

Referring to FIG. 2, the pixel PXL may include a switching transistor TS, a driving transistor Td, a storage capacitor Cst, and an organic light emitting diode OLED.

The switching transistor Ts may include a first electrode connected to a jth data line Dj, a gate electrode connected to an ith scan line Si, and a second electrode connected to the first node N1.

The switching transistor Ts may be turned on when a scan signal is supplied from the ith scan line Si, to supply a data signal received from the jth data line Dj to the storage capacitor Cst.

The storage capacitor Cst may charge a voltage corresponding to the data signal.

The driving transistor Td may include a first electrode connected to a first power source ELVDD, a second electrode connected to the organic light emitting diode OLED, and a gate electrode connected to the first node N1.

The driving transistor Td may control an amount of current flowing from the first power source ELVDD to a second power source ELVSS via the organic light emitting diode OLED, corresponding to the voltage stored in the storage capacitor Cst.

The organic light emitting diode OLED may include a first electrode (anode electrode) connected to the second electrode of the driving transistor Td and a second electrode (cathode electrode) connected to the second power source ELVSS.

The organic light emitting diode OLED may generate light corresponding to the amount of current supplied from the driving transistor Td.

The organic light emitting diode OLED may include an organic material that uniquely emits any one of primary colors of red, green, and blue or one or more lights, and the display device 1 may display a desired image by a spatial sum of the colors.

In FIG. 2, the first electrode of each of the transistors Td and Ts may be set as any one of a source electrode and a drain electrode, and the second electrode of each of the transistors Td and Ts may be set as an electrode different from the first electrode. For example, when the first electrode is set as the source electrode, the second electrode may be set as the drain electrode.

Also, each of the transistors Td and Ts may be a PMOS transistor or an NMOS transistor.

The structure of the pixel PXL shown in FIG. 2 is merely an exemplary embodiment of the invention, and therefore, the pixel PXL of the invention is not limited to the structure. The pixel PXL may have any circuit structure capable of supplying a current to the organic light emitting diode OLED, and may be selected as any one of various structures currently known in the art.

That is, the pixel PXL may further include an additional transistor and a capacitor, which compensate for a current provided to the organic light emitting diode, in addition to the switching transistor Ts and the driving transistor Td, which are shown in FIG. 2.

Figure 3:
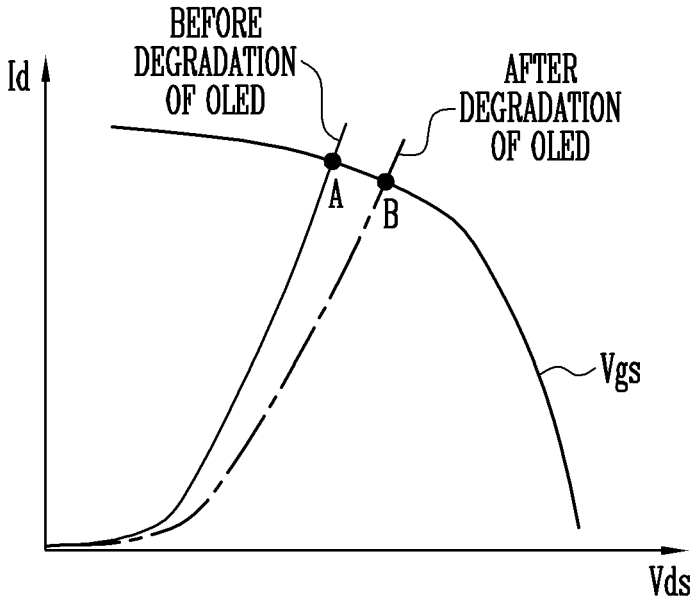
FIG. 3 is a graph illustrating a current change corresponding to degradation of the organic light emitting diode shown in FIG. 2.

FIG. 3 is a graph illustrating a current change corresponding to degradation of the organic light emitting diode shown in FIG. 2.

Referring to FIGS. 2 and 3, a predetermined current Id flows into the drain electrode of the driving transistor Td, corresponding a drain-source voltage Vds and a gate-source voltage Vgs.

When the organic light emitting diode OLED is degraded, e.g., due to manufacturing defects or tolerances, use over time and/or or other conditions known in the art, the drain-source voltage Vds applied to the driving transistor Td is changed by a change in resistance (or change in threshold voltage) of the organic light emitting diode OLED.

Specifically, before the organic light emitting diode OLED is degraded, current "A" flows corresponding to a predetermined gate-source voltage Vgs. On the other hand, when the organic light emitting diode OLED becomes degraded, current "B" lower than the current "A" flows corresponding to a predetermined gate-source voltage Vgs. That is, although the same data signal (i.e., a voltage for determining the gate-source voltage Vgs) is supplied, the amount of current supplied from the driving transistor Td to the organic light emitting diode OLED is decreased corresponding to the degradation of the organic light emitting diode OLED, and accordingly, the desired amount of brightness is not realized.

Figure 4:
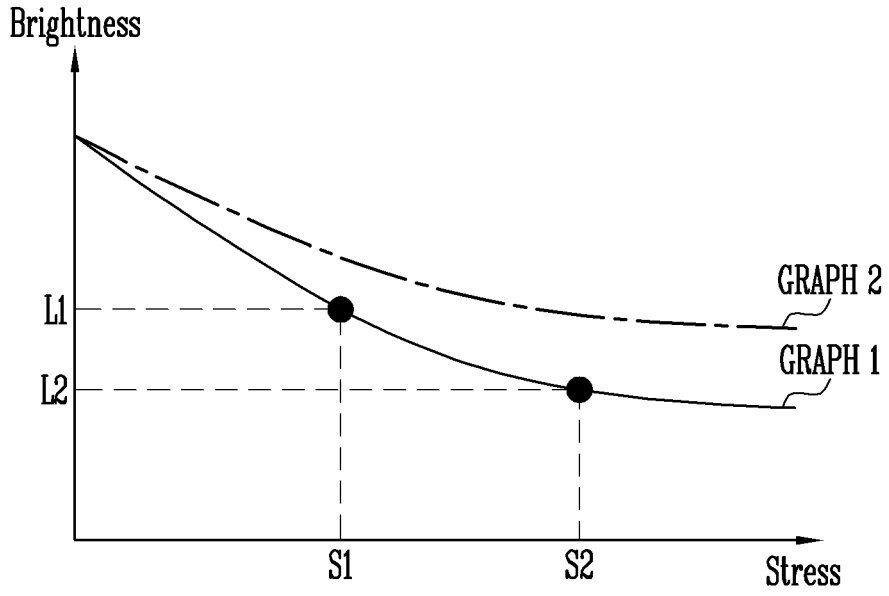
FIG. 4 is a graph illustrating a correlation between stress and brightness of the pixel.

FIG. 4 is a graph illustrating a correlation between stress and brightness of the pixel. In FIG. 4, graph 1 illustrates a correlation between brightness and stress of a pixel provided in a first display device, and graph 2 illustrates a correlation between brightness and stress of a pixel provided in a second display device. The first display device and the second display device may be fabricated using the same materials under the same process condition.

Referring to the graphs 1 and 2 of FIG. 4, brightness may decrease when stress applied to the pixel increases. Specifically, when the cumulative driving time (or cumulative driving amount) of the pixel increases, cumulative stress applied to the pixel increases. When the cumulative stress increases, an organic light emitting diode included in the pixel is degraded, and therefore, brightness may decrease.

For example, although the same data signal is applied to the pixel, the pixel applied with stress S1 may emit light with brightness L1. On the other hand, the pixel applied with stress S2 may emit light with brightness L2.

Figure 5:
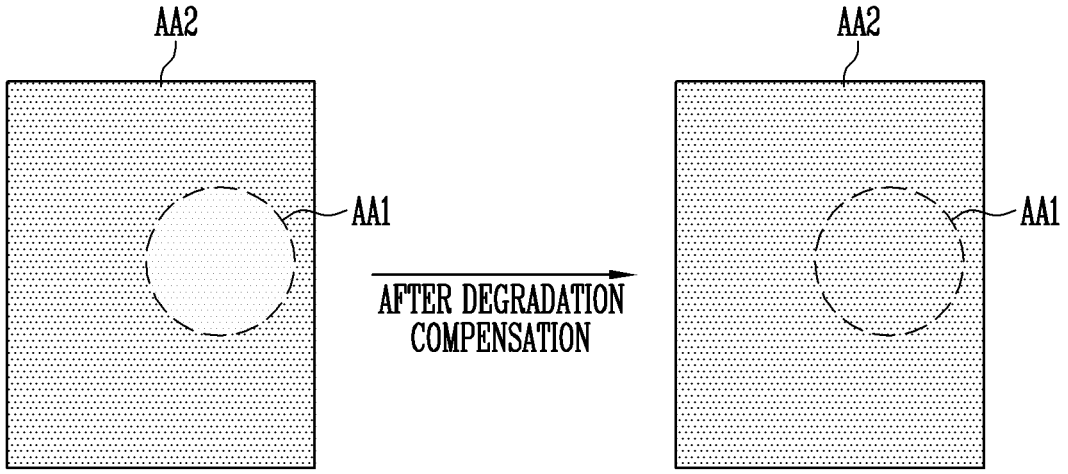
FIG. 5 is a graph illustrating a method of compensating for degradation according to an exemplary embodiment of the invention.

FIG. 5 is a graph illustrating a method of compensating for degradation according to an exemplary embodiment of the invention. FIG. 5 may exemplarily illustrate an image disposed in the display unit 100.

Referring to FIGS. 4 and 5, the stress S1 may be applied to pixels corresponding to a first region AA1, and the stress S2 may be applied to pixels corresponding to a second region AA2.

When the same data signal is supplied to the pixels corresponding to the first and second regions AA1 and AA2, the brightness of an image displayed in the first region AA1 may be higher than that of an image displayed in the second region AA2. Therefore, the data signal supplied to the pixels corresponding to the second region AA2 may be corrected such that the brightness of the image displayed in the second region AA2 may be brighter to be consistent with the brightness of the image displayed in the first region AA1. Information (e.g., a correction coefficient, etc.) for correcting the data signal may be set in advance to be stored in the display device.

However, even when display devices are fabricated under the same environment, the speeds at which pixels included in the respective display devices are degraded may be different from each other. For example, as shown in FIG. 4, a degradation degree of the pixel included in the second display device may be lower than that of the pixel included in the first display device.

Therefore, when the information for correcting the data signal is equally applied to the display devices, it may be difficult to perform accurate degradation correction because heretofore it has been necessary to set and apply correction information suitable for the entire display device based upon limited pixel correction information that is applied uniformly to all the pixels in the entire device.

Figure 6:
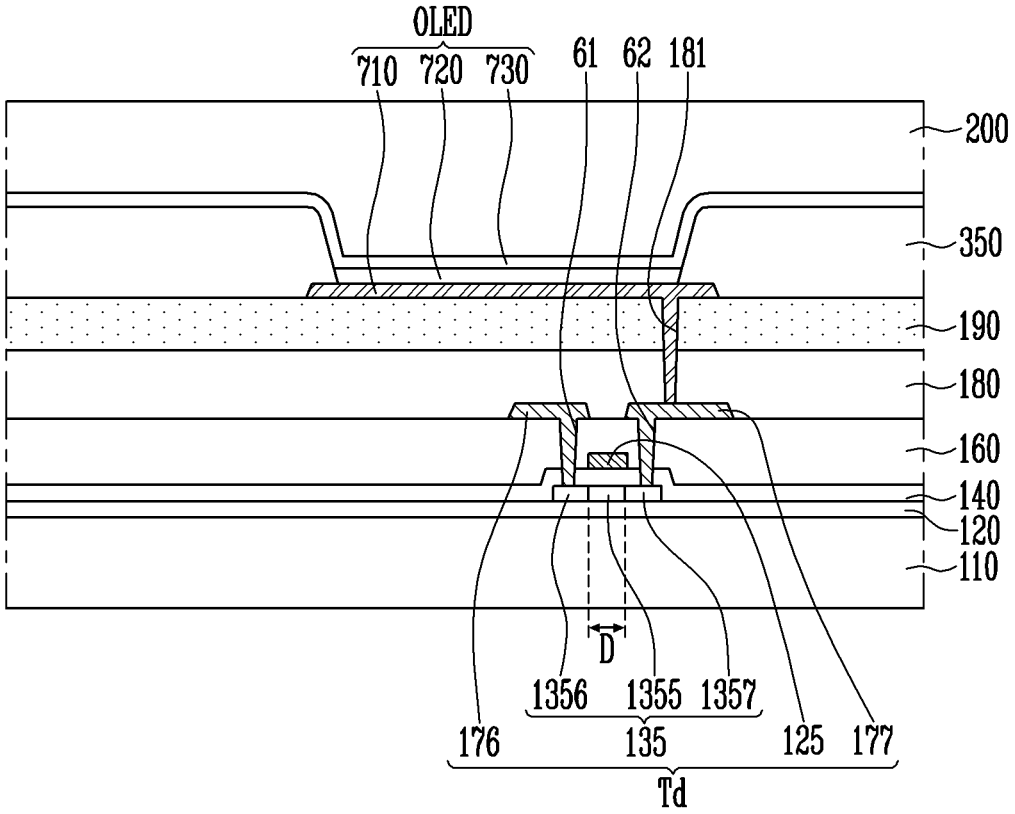
FIG. 6 is a cross-sectional view of the display device, illustrating a stacking structure of the pixel shown in FIG. 2.

FIG. 6 is a cross-sectional view of the display device, illustrating a portion of the structure of the pixel shown in FIG. 2.

The transistors Td and Ts included in the pixel PXL may be formed in the form of a thin film transistor on a substrate 110. In addition, the storage capacitor Cst and the organic light emitting diode OLED, which are included in the pixel PXL, may also be stacked and formed on the substrate 110. The driving transistor Td and the organic light emitting diode OLED connected thereto in the pixel structure shown in FIG. 2 are illustrated in FIG. 6.

Referring to FIG. 6, a buffer layer 120 including an inorganic material including silicon oxide, silicon nitride, and/or silicon oxynitride may be disposed on the substrate 110.

The buffer layer 120 may increase the smoothness of an upper surface of the substrate 110 or prevent or minimize an impurity from the substrate 110, etc. from penetrating into a semiconductor layer 135 of the driving transistor Td.

The semiconductor layer 135 may be formed on the buffer layer 120. The semiconductor layer 135 may be made of poly-silicon or oxide semiconductor.

The semiconductor layer 135 may be divided into a channel region 1355 undoped with an impurity, and a source region 1356 and a drain region 1357, which are formed by doping the impurity into both sides of the channel region 1355. The impurity may be changed depending on a kind of thin film transistor. The impurity may be an n-type impurity or a p-type impurity.

The channel region 1355 of the semiconductor layer 135 may include poly-silicon undoped with any impurity, i.e., an intrinsic semiconductor.

In addition, the source region 1356 and the drain region 1357 of the semiconductor layer 135 may include poly-silicon doped with a conductive impurity, i.e., an impurity semiconductor.

A gate insulating layer 140 for ensuring an insulating property from a gate electrode 125 is formed over the semiconductor layer 135. The gate insulating layer 140 may be provided in a single layer or a multi-layer, which includes an inorganic material including silicon oxide, silicon nitride, and/or silicon oxynitride.

The gate electrode 125 may be formed on the gate insulating layer 140. The gate electrode 125 formed on the gate insulating layer 140 may be made of a metal. The metal may include molybdenum (Mo). In addition, the metal may include at least one of gold (Au), silver (Ag), aluminum (Al), chromium (Cr), titanium (Ti), nickel (Ni), neodymium (Nd), and copper Cu, or any alloy thereof.

The gate electrode 125 may overlap with the channel region 1355. A gate electrode of the switching transistor Ts, an electrode forming the capacitor Cst, and the like may further located on the gate insulating layer 140, in addition to the gate electrode 125 of the driving transistor Td.

An interlayer insulating layer 160 may be disposed over the gate electrode 125. The interlayer insulating layer 160 may include an inorganic material including silicon oxide, silicon nitride, and/or silicon oxynitride.

A source contact hole 61 and a drain contact hole 62, which respectively expose the source region 1356 and the drain region 1357, may be formed in the interlayer insulating layer 160 and the gate insulating layer 140.

A source electrode 176 and a drain electrode 177 may be provided on the interlayer insulating layer 160. The electrodes (or lines) provided on the interlayer insulating layer 160 may be made of a metal. For example, the metal may be made of at least one of gold (Au), silver (Ag), aluminum (Al), chromium (Cr), titanium (Ti), nickel (Ni), neodymium (Nd), and copper Cu, or any alloy thereof.

The source and drain electrodes of the switching transistor Ts, an electrode forming the capacitor Cst, and the like may be further located on the interlayer insulating layer 160, in addition to the source electrode 176 and the drain electrode 177 of the driving transistor Td.

The semiconductor layer 135, the gate electrode 125, the source electrode 176, and the drain electrode 177 may form the driving transistor Td.

A passivation layer 180 may be provided over the source electrode 176 and the drain electrode 177.

The passivation layer 180 may be an inorganic insulating layer made of an inorganic material. The inorganic material may include polysiloxane, silicon nitride, silicon oxide, silicon oxynitride, etc. In some exemplary embodiments, the passivation layer 180 may be omitted.

An organic insulating layer 190 may be formed on the passivation layer 180. The organic insulating layer 190 may be an organic insulating layer made of an organic material. The organic material may include an organic insulating material such as a polyacryl-based compound, a polyimide-based compound, a fluorine-based compound such as Teflon, or a benzocyclobutene-based compound.

A first pixel electrode 710 may be formed on the organic insulating layer 190. The first pixel electrode 710 may include a transparent conductive material such as indium tin oxide (ITO), indium zinc oxide (IZO), zinc oxide (ZnO) or indium oxide ($In_2O_3$), or a reflective metal such as lithium (Li), calcium (Ca), lithium fluoride/calcium (LiF/Ca), lithium fluoride/aluminum (LiF/Al), aluminum (Al), silver (Ag), magnesium (Mg) or gold (Au).

The first pixel electrode 710 is electrically connected to the drain electrode 177 of the driving transistor Td through a contact hole 181 formed in the passivation layer 180 and the organic insulating layer 190, and may become an anode electrode of the organic light emitting diode OLED.

A pixel defining layer 350 may be formed on the organic insulating layer 190 and an edge portion of the first pixel electrode 710. The pixel defining layer 350 may include an opening exposing the first pixel electrode 710. That is, the pixel defining layer 350 may define a pixel region to correspond to each pixel.

The pixel defining layer 350 may be an organic insulating layer made of an organic material. The organic material may include an organic insulating material such as a polyacryl-based compound, a polyimide-based compound, a fluorine-based compound such as Teflon, or a benzocyclobutene-based compound.

An organic emitting layer 720 may be provided in the opening of the pixel defining layer 350.

A second pixel electrode 730 may be provided on the pixel defining layer 350 and the organic emitting layer 720.

The second pixel electrode 730 may be made of a metal layer such as Ag, Mg, Al, Pt, Pd, Au, Ni, Nd, Ir or Cr, and/or a transparent conductive layer such as indium tin oxide (ITO), indium zinc oxide (IZO), zinc oxide (ZnO) or indium tin zinc oxide (ITZO).

As described above, as the first pixel electrode 710 becomes the anode electrode of the organic light emitting diode OLED, the second pixel electrode 730 may become a cathode electrode of the organic light emitting diode OLED.

However, in some cases, the first pixel electrode 710 may become a cathode electrode, and the second pixel electrode 730 may become an anode electrode.

The first pixel electrode 710, the organic emitting layer 720, and the second pixel electrode 730 may form the organic light emitting diode OLED.

An encapsulation layer 200 may be provided over the second pixel electrode 730. The encapsulation layer 200 may prevent oxygen and moisture from penetrating into the organic light emitting diode OLED. The encapsulation layer 200 may include a plurality of inorganic layers and/or a plurality of organic layers. For example, the encapsulation layer 200 may include a plurality of unit encapsulation layer each including the inorganic layer and the organic layer disposed on the inorganic layer.

The speed at which the pixel is degraded may vary depending on the distance D between the source region 1356 and the drain region 1357 of the driving transistor Td. The distance D between the source region 1356 and the drain region 1357, which is used herein, may be the shortest distance between the source region 1356 and the drain region 1357.

Figure 7:
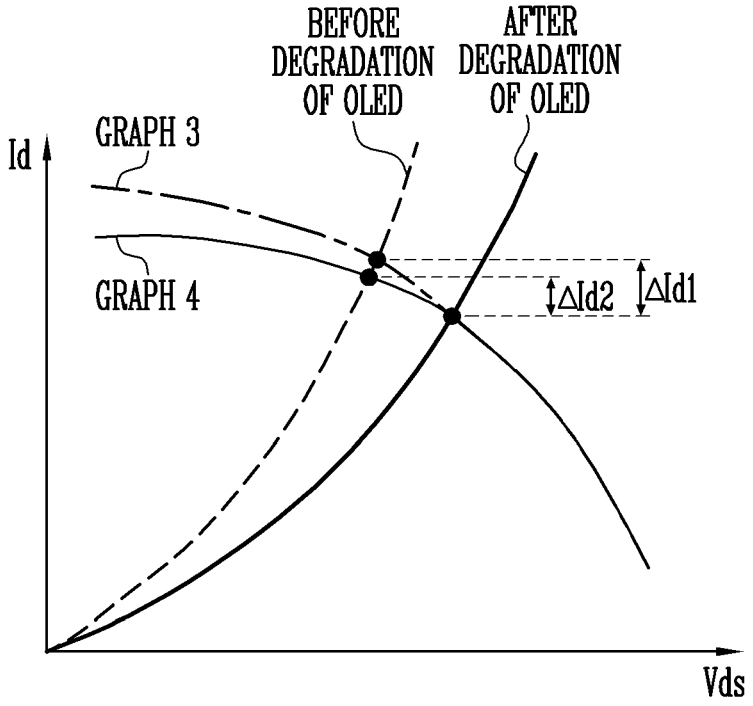
FIG. 7 are graphs illustrating a current change corresponding to degradation of the organic light emitting diode.

FIG. 7 are graphs illustrating a current change corresponding to degradation of the organic light emitting diode.

Graph 3 in FIG. 7 illustrates a current change corresponding to degradation of the organic light emitting diode connected to the driving transistor having the distance D between the source region 1356 and the drain region 1357, which is d1. In addition, graph 4 illustrates a current change corresponding to degradation of the organic light emitting diode connected to the driving transistor having the distance D between the source region 1356 and the drain region 1357, which is d2, where d2 is larger than d1.

Referring to the graph 3 of FIG. 7, the difference between an amount of current flowing through the organic light emitting diode before the organic light emitting diode is degraded and an amount of current flowing through the organic light emitting diode after the organic light emitting diode is degraded may be ΔId1. In addition, referring to the graph 4 of FIG. 7, the difference between an amount of current flowing through the organic light emitting diode before the organic light emitting diode is degraded and an amount of current flowing through the organic light emitting diode after the organic light emitting diode is degraded may be ΔId2 smaller than ΔId1. That is, when the distance D between the source region 1356 and the drain region 1357 of the driving transistor Td increases, the speed at which the organic light emitting diode is degraded may be further decreased.

Figure 8:
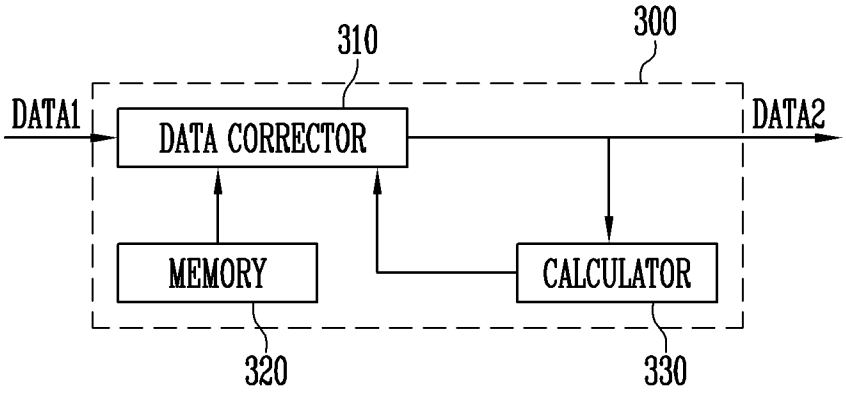
FIG. 8 is a block diagram schematically illustrating a configuration of a degradation compensator included in a timing controller according to an exemplary embodiment of the invention.

FIG. 8 is a block diagram schematically illustrating a configuration of a degradation compensator included in the timing controller according to an exemplary embodiment of the invention.

Referring to FIG. 8, the degradation compensator 300 according to the exemplary embodiment of the invention may include a data corrector 310, a memory 320 (or memory device), and a calculator 330.

The calculator 330 may calculate stress of a pixel, using first image data DATA1 supplied from outside of the degradation compensator 300. The calculator 330 may calculate cumulative stress information for each pixel by cumulating, for each pixel, display time, gray, brightness, and temperature information included in the first image data DATA1.

A data correction coefficient corresponding to a cumulative stress value may be stored in the memory 320. The data correction coefficient may be set with reference to the distance between the source region and the drain region of the driving transistor.

To this end, a distance between the source region and the drain region of the driving transistor may be measured during a fabricating process of the display device. For example, a distance between the source region and the drain region of the driving transistor, which are arranged at a specific position (e.g., the center of the display device), may be measured, and a data correction coefficient may be set with reference to the measured distance. Alternatively, a distance between the source region and the drain region of each of driving transistors provided in the display device may be measured, and a data correction coefficient may be set with reference to an average value of the measured distances. Alternatively, a distance between the source region and the drain region of each of driving transistors arranged at a specific region (e.g., a region including the center of the display device) may be measured, and a data correction coefficient may be set with reference to an average value of the measured distances.

For example, a weighted value W corresponding to the distance between the source region and the drain region of each of the driving transistors may be calculated using the following Equation 1.

$$W = \alpha \times \frac{Lo}{L} \qquad \text{Equation 1}$$

In Equation 1, L may mean a reference distance between the source region and the drain region of a driving transistor, which is used as a preset value. Also, Lo may mean a distance between the source region and the drain region of each of the driving transistors, which is actually measured. Also, α may be a coefficient having an arbitrary value, and be differently applied depending on the cumulative stress value.

When the weighted value W corresponding to the distance between the source region and the drain region of each of the driving transistors is calculated, a data correction coefficient CF(Si) when the cumulative stress is Si may be calculated using the following Equation 2.

$$CF(Si)=W\times CFb(Si) \quad \text{Equation 2}$$

In Equation 2, CFb may mean a reference data correction coefficient when the cumulative stress is Si. The data correction coefficient that becomes the reference may be applied to a pixel including the driving transistor having the distance between the source region and the drain region, which is L, and be a value set for each cumulative stress through a simulation, etc.

The data corrector 310 shown in FIG. 8 may generate second image data DATA2 by applying cumulative stress information for each pixel and a data correction coefficient acquired from the memory 320 to the first image data DATA1.

That is, when the calculator 330 determines that the cumulative stress of the pixel is Si, the data corrector 310 may acquire the data correction coefficient CF(Si) from the memory 320. Also, the data corrector 310 may output the second image data DATA2 by applying the data correction coefficient CF(Si) to the first image data DATA1.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a plurality of pixels each of which includes a light emitting element and a driving transistor having a source region separated from a drain region by a distance to control an amount of current flowing through the light emitting element;

a timing controller to convert a first image data input into a second image data using a data correction coefficient set corresponding to the distance of one of the plurality of pixels; and a data driver to generate a data signal corresponding to the second image data and to supply the data signal to the one of the plurality of pixel, wherein:

the data correction coefficient is set to decrease when the distance between the source region and the drain region of the driving transistor increases.

2. The display device of claim 1, wherein the timing controller comprises:

a calculator to calculate and store cumulative stress information of at least some of the plurality of pixels, based on the first image data;

a memory to store the data correction coefficient; and a data corrector to convert the first image data into the second image data, using the cumulative stress information and the data correction coefficient on a pixel by pixel basis.

3. The display device of claim 2, wherein the data correction coefficient is calculated by applying a weighted value corresponding to the distance between the source region and the drain region of the driving transistor to a reference data correction coefficient.

4. The display device of claim 3, wherein the weighted value is set to decrease when the distance between the source region and the drain region of the driving transistor increases.

5. The display device of claim 2, wherein the data correction coefficient respectively corresponding to a plurality of cumulative stress information having different values are stored in the memory.

6. The display device of claim 1, wherein the data correction coefficient is used to compensate for degradation of the light emitting element.

7. The display device of claim 1, wherein the distance between the source region and the drain region of the driving transistor is the shortest distance between the source region and the drain region.

8. A method of compensating for degradation of a display device including a plurality of pixels each of which including a light emitting element and a driving transistor to control current flowing through the light emitting element, the method comprising the steps of:

storing, in a memory, a plurality of data correction coefficients corresponding to a previously measured distance between a source region and a drain region of the driving transistor of at least some of the plurality of pixels; and converting, by a timing controller, a first image data input into a second image data, using the plurality of data correction coefficients to drive at least some of the plurality of pixels, wherein:

the plurality of data correction coefficients are set to decrease when the distance between the source region and the drain region of the driving transistor increases.

9. The method of claim 8, further comprising the step of calculating, by the timing controller, a cumulative stress information of at least some of the plurality of pixels, based on the first image data.

10. The method of claim 9, wherein the second image data is converted using one of the plurality of data correction coefficients corresponding to the calculated cumulative stress information.

11. The method of claim 10, wherein the plurality of data correction coefficients are calculated by applying a weighted value corresponding to the distance between the source region and the drain region of the driving transistor to a reference data correction coefficient.

12. The method of claim 11, wherein the weighted value is set to decrease when the distance between the source region and the drain region of the driving transistor increases.

13. The method of claim 11, wherein the weighted value is set to increase when the distance between the source region and the drain region of the driving transistor decreases.

14. The method of claim 8, wherein the distance between the source region and the drain region of the driving transistor is the shortest distance between the source region and the drain region.

15. The method of claim 8, wherein the plurality of data correction coefficients are used to compensate for degradation of the light emitting element.

* * * * *